US006517363B2

(12) United States Patent
Ross

(10) Patent No.: US 6,517,363 B2
(45) Date of Patent: Feb. 11, 2003

(54) CONNECTION ASSEMBLY FOR ELECTRICAL BUSWAYS

(75) Inventor: Steven L. Ross, Pittsburgh, PA (US)

(73) Assignee: Universal Electric Corporation, Bridgeville, PA (US)

( * ) Notice: Subject to any disclaimer, the term of this patent is extended or adjusted under 35 U.S.C. 154(b) by 0 days.

(21) Appl. No.: 09/896,638

(22) Filed: Jun. 29, 2001

(65) Prior Publication Data

US 2003/0003785 A1 Jan. 2, 2003

(51) Int. Cl.[7] ..... H01R 25/00
(52) U.S. Cl. ..... 439/115; 439/116
(58) Field of Search ..... 439/110–119, 212, 439/213; 174/138 F, 99 B; 361/675, 642

(56) References Cited

U.S. PATENT DOCUMENTS 2,150,963 A * 3/1939 De Mask ..... 174/68.2
3,263,131 A * 7/1966 Rowe ..... 174/99 B
3,628,097 A * 12/1971 Kobryner ..... 361/659
3,801,751 A 4/1974 Ross, Jr.
4,179,174 A * 12/1979 Jorgensen ..... 174/88 B
4,218,108 A * 8/1980 El Mouchi ..... 200/51 R
4,655,520 A * 4/1987 Cummings ..... 439/111
5,092,787 A * 3/1992 Wise et al. ..... 437/211
6,039,584 A 3/2000 Ross
6,105,741 A 8/2000 Ross
6,176,711 B1 * 1/2001 Rohr et al. ..... 174/98

* cited by examiner

*Primary Examiner*—Neil Abrams
*Assistant Examiner*—Phuong Dinh
(74) *Attorney, Agent, or Firm*—William F. Lang, IV; Eckert Seamans Cherin & Mellott, LLC

(57) ABSTRACT

An improved electrical bus system maximizes the distance that electrical current must travel between adjacent buses before a short can occur by placing the buses at the top portion of upside down U-shaped channels within the insulator, and connecting the adjacent U-shaped channels at their bottom ends. The buses are exposed at each end of a bus section, with a joint insulator frictionally secured between the bus insulator and housing to provide insulation for these exposed bus ends. Adjacent bus sections are electrically connected using a snap-on connector extending across the adjacent bus sections. If a neutral bus is included, for example, in a three-phase system, the neutral bus is located directly between a pair of live buses. Because the potential between a live bus and a neutral bus is one-half the potential between two live buses, the live buses may be positioned closer to the neutral bus than another live bus.

24 Claims, 6 Drawing Sheets

CONNECTION ASSEMBLY FOR ELECTRICAL BUSWAYS

BACKGROUND OF THE INVENTION

1. Field of the Invention

The present invention relates to electrical busways. More specifically, the invention relates to an improved electrical busway wherein the electrical insulation between adjacent buses is maximized, and the overall space required for the busway is minimized.

2. Description of the Related Art

Electrical bus systems are commonly used to provide electricity in locations wherein the location of the final electrical load must be highly flexible. Common examples include trolley systems, light assemblies for commercial establishments, and/or electrical outlets and connections for assembly lines. Such systems typically include two to four buses (wires), with each wire being insulated on three sides and exposed on one side. A typical bus system will include four wires, with three wires providing alternating current in phases that are 120° apart, and the fourth wire being a neutral, commonly known as a three-phase system. The housing is dimensioned and configured so that electrical loads such as light fixtures, electrical outlets, etc. may be removably secured within the housing, with contacts on the electrical load electrically connected to the buses. Typical bus systems include individual track sections, typically ranging in length from two to twenty feet, with electrical connections between the corresponding buses within each of the adjacent track sections.

Presently available bus systems use insulation around the buses having a flat back surface, and flanges or legs extending approximately 90° away from the back surface, thereby forming approximately U-shaped channels for insulating the buses. Such a bus system must provide sufficient space between adjacent buses so that the electric potential between the two adjacent buses is insufficient to overcome the resistance of the insulating material between the buses, combined with the resistance of the air between the buses. This electrical resistance is a function of both the resistivity of the material, and the distance current must travel through the material between one bus and the adjacent bus.

Track lighting systems are similar to electrical bus systems, but are not required to provide the same level of electrical insulation. A typical track lighting system provides insulation merely through physical separation of the individual buses. One presently available track lighting system, having two buses, utilizes insulation covering three sides of each bus, with adjacent insulation sections joined together at their top ends, forming a W-shaped profile when viewed from one end.

The drawback of many presently available systems is the distance required between adjacent buses to provide sufficient electrical resistance to prevent a short between the buses. This distance requirement enlarges the overall structure of the bus section.

Some presently available bus systems also provide connectors between adjacent bus sections with the connectors providing insulation around three sides of an individual bus at the joint between adjacent track sections. Presently available connectors require removal of the insulation from around the bus bar at the joint before the connector can be used to provide insulation between adjacent track sections, thereby complicating assembly of a bus system.

Accordingly, there s a need for a bus system wherein the overall space required by the system is minimized, but the electrical resistance between adjacent buses is maximized by maximizing the distance through which electricity must travel between these buses within this minimized overall space. There is also a need for an improved connector for providing both electrical connection between corresponding buses, and insulation around the buses at the joint between adjacent track sections, thereby facilitating assembly of the bus system.

SUMMARY OF THE INVENTION

The present invention is an improved electrical bus system, wherein the distance electricity must travel from one bus to an adjacent bus, thereby creating a short, is maximized within a minimized overall space, thereby increasing the overall resistance of the insulation between adjacent buses. The present invention also provides an improved connection between adjacent bus sections, providing the necessary electrical connections and insulation, and simplified assembly. The bus system includes a plurality of bus sections, with each section having a housing, a bus bar insulator, and two to four bus bars. The individual track sections are joined by joint insulators and connectors.

Each bus section preferably includes at least two buses (wires) for carrying electricity between its source and its load. A preferred embodiment includes four buses, with three of the buses carrying alternating electrical current in phases 120° apart, and a fourth neutral bus, commonly known as a three-phase system. The neutral bus is preferably located between two of the three live buses. Because the electric potential between a live bus and a neutral bus is approximately one-half the potential between two live buses located the same distance apart, the neutral bus may be located relatively close to the live buses on either side. Therefore, the only place within the track section requiring substantial space between adjacent buses is the one location wherein two live buses are adjacent to each other.

A bus bar insulator surrounds the buses. The bus bar insulator is made from electrically resistive material, for example, plastic. The bus bar insulator includes an upside down U-shaped section dimensioned and configured to receive each bus bar, with adjacent U-shaped sections connected at their bottom ends. The inside walls of the bus bar insulator include flanges dimensioned and configured to retain the bus bars at the top of the U-shaped sections. The resulting configuration would require electricity traveling from one bus bar to an adjacent bus bar through the insulation to travel from the top to the bottom section of the first bus insulator section, across the joint between adjacent sections, and then from the bottom to the top of the second bus insulator section. This relatively long distance between adjacent bus bars through the insulation maximizes the total resistivity through the insulation between adjacent bus bars. Because the resistivity of air is higher than the resitivity of the insulation, the individual bus bars may be located closer together horizontally without the risk of a short created by current passing through the air, and without reducing the distance through the insulator that current must travel to create a short. The bus insulation preferably terminates a short distance from the end of the buses within a given track section, with an example distance between the end of the bus bar and end of the insulation being approximately one inch.

The housing includes a middle section dimensioned and configured to contain the bus bars and bus bar insulator, a top section dimensioned and configured to secure the bus section to a ceiling, and a bottom section dimensioned and configured to receive and secure electrical devices such as lighting systems and electrical outlets.

Adjacent bus sections are joined utilizing a joint insulator and a connector. The joint insulator includes a top section and a plurality of downwardly extending legs, with each leg fitting either between two adjacent buses, or on either side of the row of buses. One end of a joint insulator fits between the bus insulator and the housing, and the other end is substantially even with the end of the housing. In use, the joint insulators bridge the gap between the bus insulators of adjacent bus sections, fitting above each bus bar insulator, between this insulator and the housing. The joint insulator covers that portion of the bus bars not covered by the bus bar insulator.

The connector includes a plurality of electrically conductive U-shaped clamp structures, with each clamp dimensioned and configured to snap onto a single bus bar within two adjacent track sections, thereby forming an electrical connection between these two bus bars. The connector therefore includes one U-shaped clamp for each pair of bus bars to be electrically connected. The remainder of the connector is made from electrically insulating plastic, thereby providing additional insulation around the joint between adjacent track sections. When a bus system is being assembled, a pair of adjacent sections will be mounted in their desired location (preferably on the ceiling), with the joint insulator fixed in each section to cover the ends of the busbars, and a connector will be snapped in place, securing the exposed ends of the buses at the joint.

An electrical load, such as a light fixture or electrical outlet, will be electrically connected to the buses by plugging into the bottom of the bus assembly. The electrical load will have a prong corresponding to each of the buses within the bus assembly. The electrical load will also include means for removably securing the load to a desired location within a track section. Preferred and suggested means include spring retention devices, having flanges dimensioned and configured to engage the bottom portion of the housing, and finger engaging portions, which, when depressed, bias the flanges away from the housing, permitting the electrical load to be removed.

It is therefore an aspect of the present invention to provide an electrical bus system wherein the distance electricity must flow between adjacent buses to create a short is maximized within a minimized overall space.

It is another aspect of the present invention to provide an electrical bus system wherein individual bus sections may be joined without the need for removing material from any portion of either section.

It is a further aspect of the present invention to provide an electrical bus system wherein adjacent sections may be joined by snapping a connector into place across the corresponding buses within the adjacent sections.

These and other aspects of the invention will become apparent through the following description and drawings.

BRIEF DESCRIPTION OF THE DRAWINGS

Like reference numbers denote like elements throughout the drawings.

DETAILED DESCRIPTION

Figure 1:
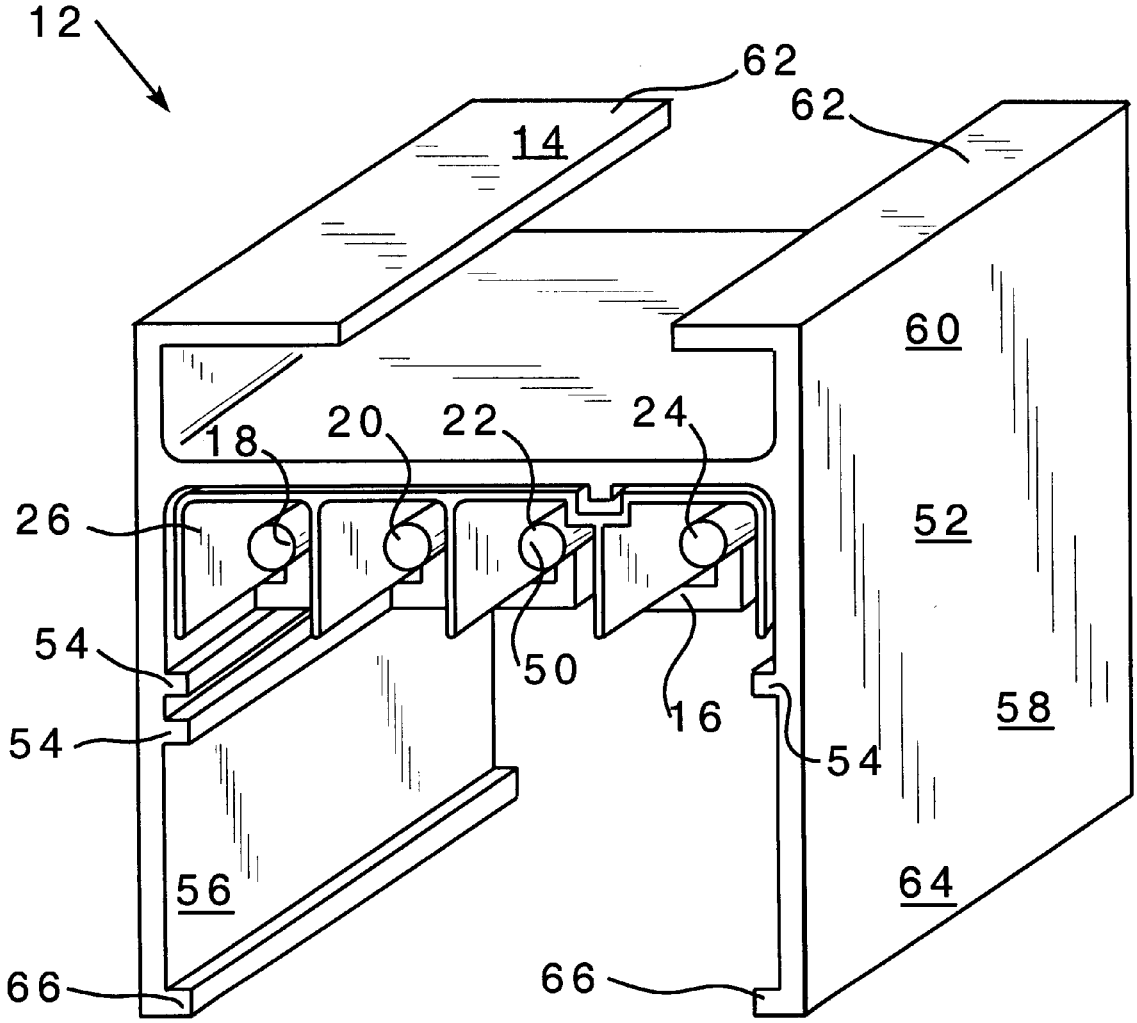
FIG. 1 is an isometric view of a single electrical bus section according to the present invention.

The present invention is an improved electrical bus system. Although the present description references a top and bottom in describing various features, it is to be understood that the present invention may be utilized in any orientation, and such references are for convenience of description only. Referring to the Figures, the bus system 10 includes a plurality of bus sections 12, with each section 12 having a housing 14, a bus bar insulator 16, and at least two bus bars 18, 20, 22, 24. The individual track sections are joined by joint insulators 26 and connectors 28.

Figure 2:
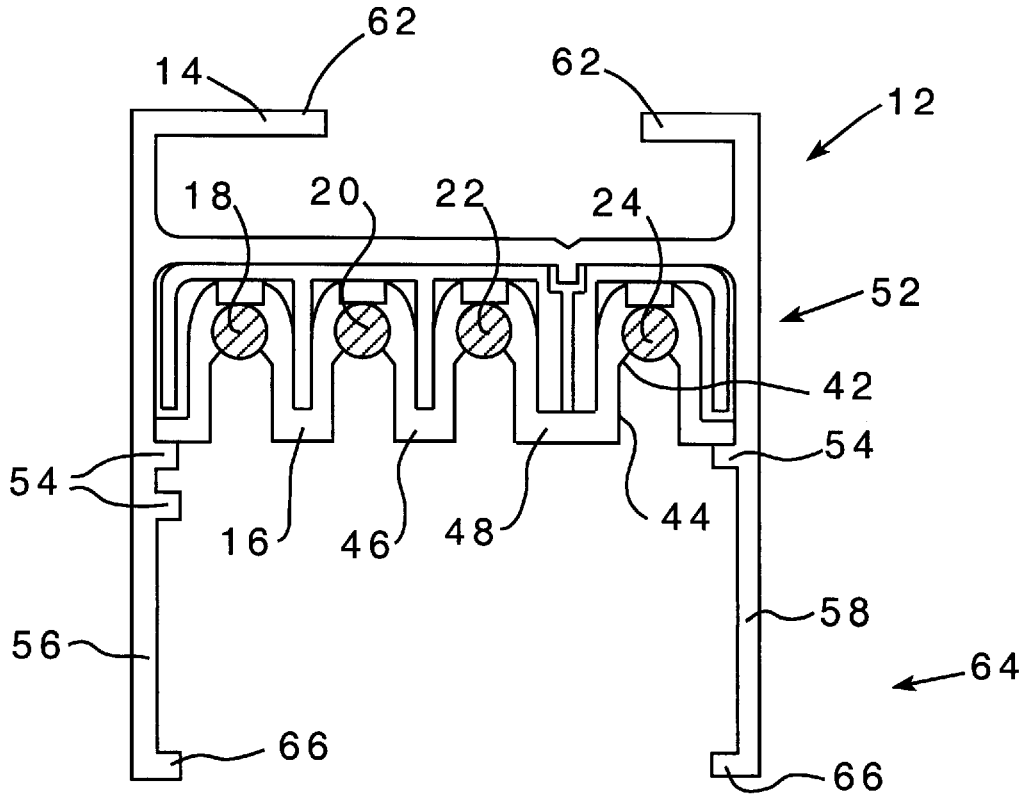
FIG. 2 is an end view of a single bus section according to the present invention.
Figure 3:
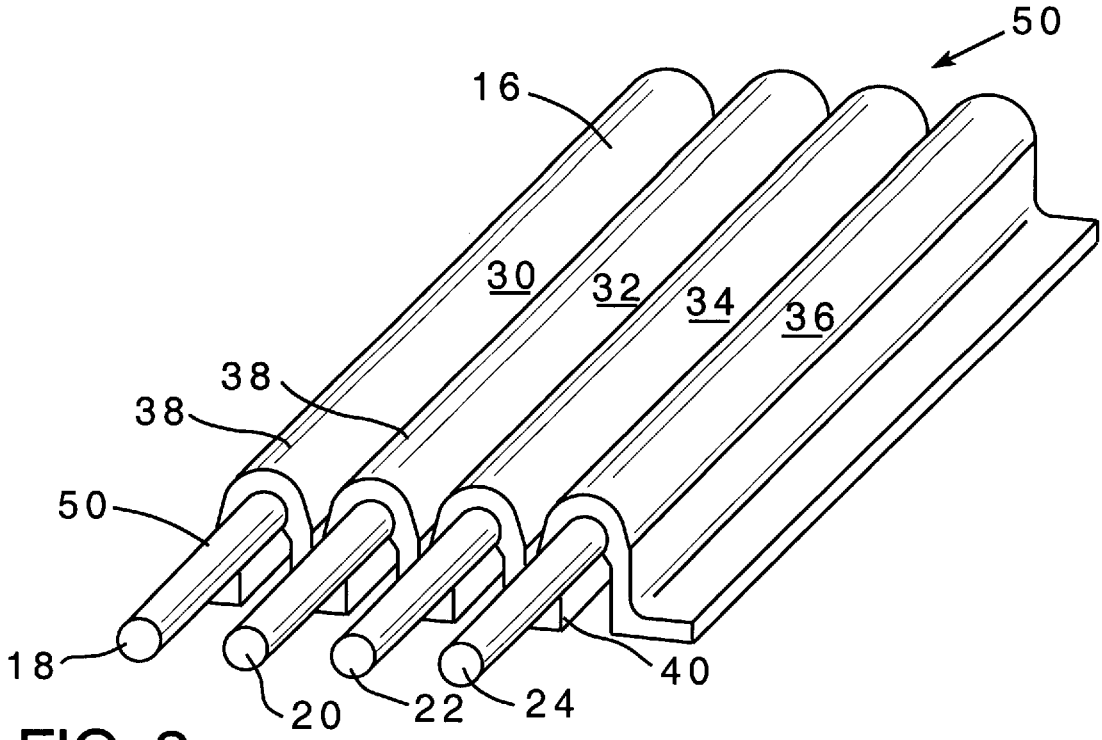
FIG. 3 is a top isometric view of the bus bars and bus bar insulator according to the present invention.

As best illustrated in FIGS. 1–3, each bus section preferably includes at least two buses (wires) for carrying electricity between its source and its load. A preferred embodiment includes four buses 18, 20, 22, 24, with three of the buses 18, 22, 24 carrying alternating electrical current in phases 120° apart, and a fourth neutral bus 20. This combination of three live buses and one neutral bus is commonly known as a three-phase system. The neutral bus 20 is preferably located between two live buses 18, 22. In some preferred embodiments, the buses 18,20,22,24 will be located within a single plane.

The buses 18, 20, 22, 24 are surrounded by a bus insulator 16. The bus insulator 16 is made from electrically resistive material, for example, plastic. The bus insulator 16 includes upside down U-shaped sections 30, 32, 34, 36, with each U-shaped section 30, 32, 34, 36 including a center portion 38 at its upper end, and a pair of end portions 40 at its lower end. Each of the U-shaped sections 30, 32, 34, 36 of the bus insulator 16 includes at least one flange 42 protruding from one of its walls 44. Each U-shaped section 30, 32, 34, 36 is thereby dimensioned and configured to retain a bus 18, 20, 22, 24 within the center portion of the U-shaped section 30, 32, 34, 36. The end portions 40 of adjacent U-shaped sections 30, 32, 34 are joined with relatively short insulator connector portions 46. Likewise, the end portions 40 of adjacent U-shaped sections 34, 36 are joined with a relatively long insulator connector portion 48. The bus insulator 16 is dimensioned and configured so that the ends 50 of the buses 18, 20, 22, 24 protrude from the bus insulator 16. One example distance for which the ends 50 protrude from the bus insulator 16 is approximately one inch.

A housing 14 for each bus section 12 includes a middle section 52, dimensioned and configured to secure the bus insulator 16 therein. One preferred means for securing the bus insulator 16 within the middle section 52 includes the flanges 54, protruding inward from the outside walls 56, 58 of the housing 14. The bus bars 18,20,22,24 are dimensioned and configured to terminate slightly inside the housing 14, for example, approximately 0.25 in. inside the housing. The top or bus mounting portion 60 of the housing 14 is dimensioned and configured to facilitate securing the housing 14 to a desired location, for example, the ceiling of a building. The housing's mounting portion 60 may therefore include at least one mounting surface 62. The bottom or electrical load mounting portion 64 of the housing 14 is dimensioned and configured to removably secure an electrical load, such as a light fixture or an electrical outlet, to the bus section 12. One preferred means of securing an electrical load within the electrical load mounting portion 64 includes the flanges 66, projecting inwardly from the outside walls 56, 58.

Figure 4:
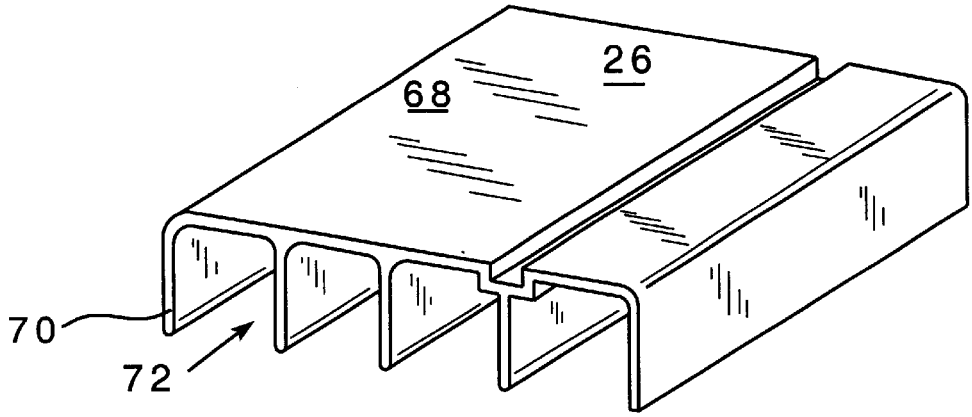
FIG. 4 is a top isometric view of a joint insulator according to the present invention.
Figure 5:
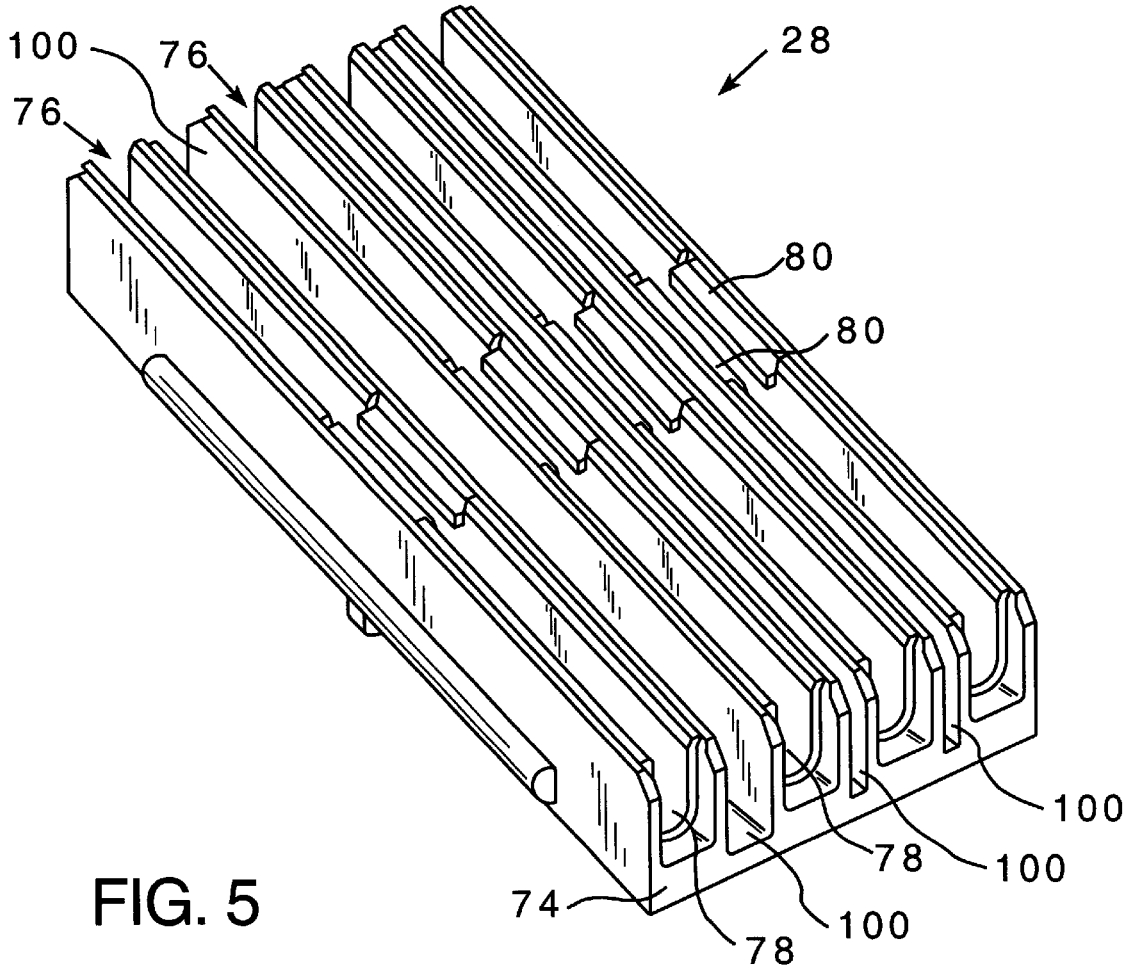
FIG. 5 is a top isometric view of a connector for providing electrical connection between adjacent bus sections according to the present invention.

Referring to FIGS. 4–5, adjacent bus sections 12 are connected to form bus systems 10 through the use of a joint insulator 26, and connector 28. The joint insulator 26 includes a top surface 68, and a plurality of downwardly projecting walls 70, thereby defining a channel 72 corresponding to each of the buses 18, 20, 22, 24. Each of the channels 72 is also dimensioned and configure to contain the U-shaped sections 30, 32, 34, 36 of the bus insulator 16. Each joint insulator 26 is dimensioned and configured to fit between the bus insulator 16 and housing 14, being frictionally secured in place between these parts, and to terminate approximately even with the end of the housing. In some preferred embodiments, a pair of joint insulators will be supplied as integral, pre-assembled portions of a bus section, as illustrated in FIGS. 1, 2, 6, and 7.

The connector 28 includes a connector insulator portion 74, defining a channel 76 corresponding to each of the buses 18, 20, 22, 24. Each of the channels 76 includes an electrically conductive, U-shaped clamp 78, dimensioned and configured to removably secure the ends 50 of the buses 18, 20, 22, 24 of adjacent bus sections 12, thereby forming an electrical connection between each of the buses 18, 20, 22, 24 within a first bus section 12, and its corresponding bus 18, 20, 22, 24 within an adjacent bus section 12. The connector 28 may also include clamp retainers 80, securing the clamps 78 within the channels 76. The channels 100, located between the channels 76, are dimensioned and configured to receive the walls 70 of the joint insulator 26.

Figure 6:
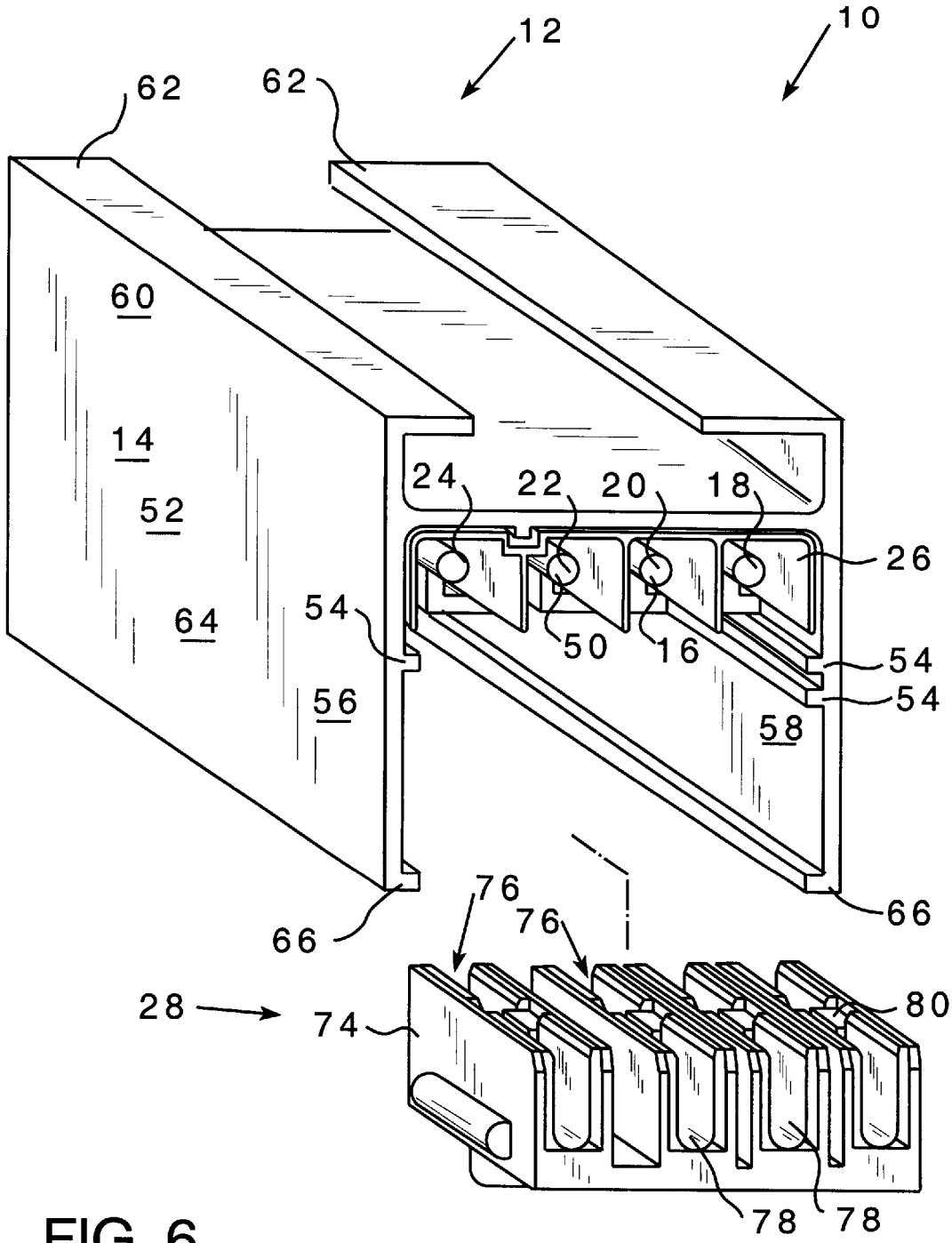
FIG. 6 is a partially exploded, top isometric view of an individual bus section and an adjoining connector according to the present invention.
Figure 7:
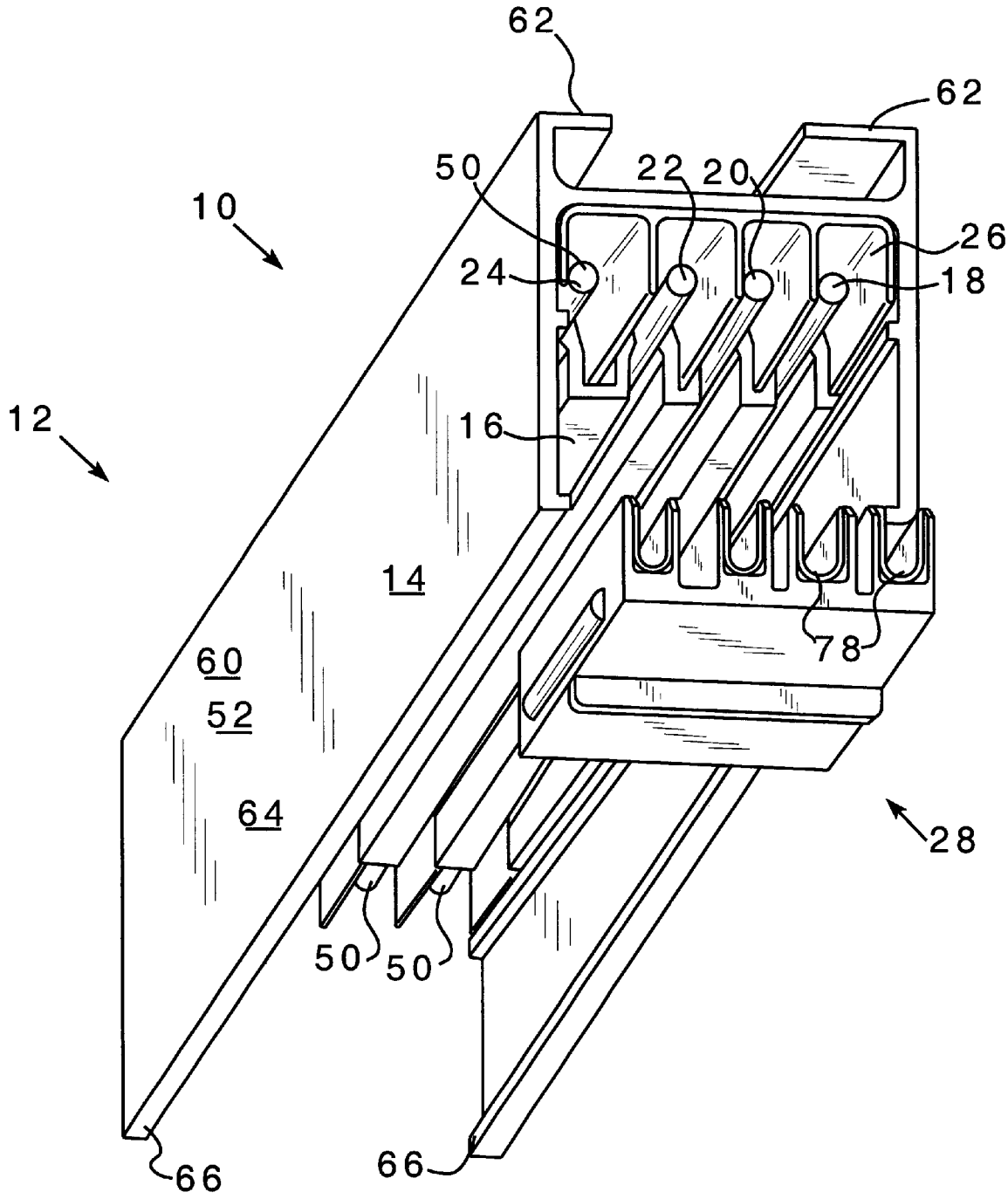
FIG. 7 is a partially exploded bottom isometric view of a single bus section and an adjacent connector according to the present invention.

Referring to FIGS. 6 and 7, the assembly of bus sections 12, joint insulators 26 and connectors 28 to form a bus system 10 is illustrated. A first bus section 12 is secured in a desired location, for example, by securing the mounting surface 62 to a ceiling. A second bus section 12 may then be positioned adjacent to the first bus section 12. The joint insulators 26 of the adjacent bus sections 12 will also be directly adjacent, thereby providing insulation across the exposed ends 50 of the buses 18, 20, 22, 24 of both adjacent bus sections 12. The second bus section 12 may then be secured in its desired location, for example, securing the mounting surface 62 to a ceiling. Lastly, the connector 28 is installed to provide an electrical connection between the corresponding buses 18, 20, 22, 24 within the adjacent bus sections 12. The connector 28 may be placed directly under the exposed ends 50 of the buses 18, 20, 22, 24 and pressed upward, thereby snapping the connector 28 into place so that each clamp 78 secures one pair of the corresponding buses 18, 20, 22, 24.

Figure 8:
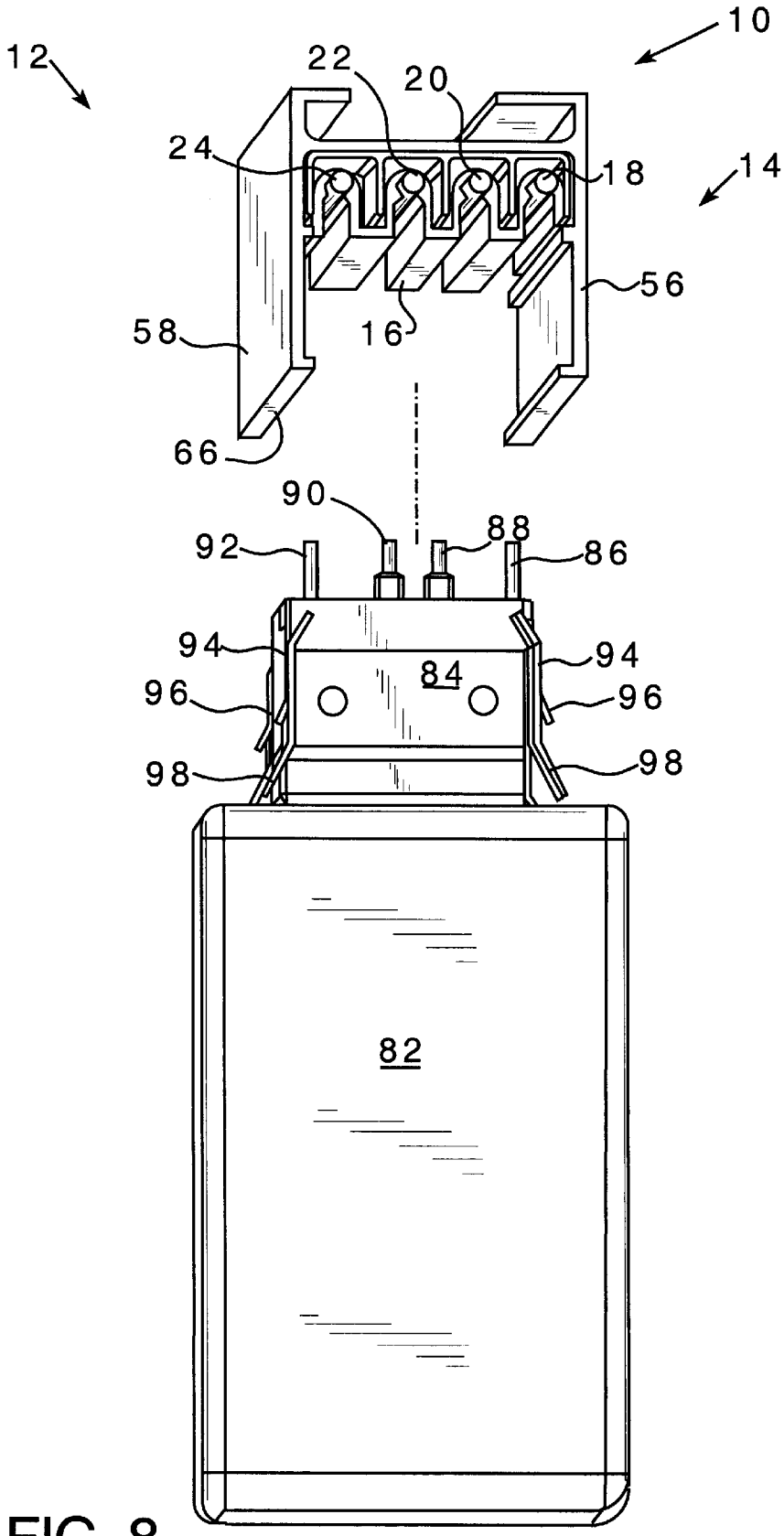
FIG. 8 is a partially exploded, bottom isometric view of a single bus section, with an electrical outlet dimensioned and configured for electrical connection to a busway according to the present invention.

Referring to FIG. 8, use of the bus system 10 to supply electrical power to an electrical load 82 is illustrated. In the present example, the electrical load 82 is an electrical outlet, similar to a standard wall outlet. The electrical outlet 82 includes a top portion 84 having electrically conductive prongs 86, 88, 90, 92, with each prong 86, 88, 90, 92, corresponding to one of the buses 18, 20, 22, 24. Because the entire bottom surface of the buses 18, 20, 22, 24 are exposed except where the connector 28 is located, the electrical outlet 82 may be placed at any desired position along the entire length of a bus section 12, with the exception of that portion covered by the connector 28. Each side of the top portion 84 of the electrical outlet 82 includes a spring retention member 94, having a flange 96 and a finger-engaging portion 98. The flanges 96 are dimensioned and configured to engage the flanges 66 of the housing 14, thereby removably securing the electrical outlet 82 within the bus section 12. When installing the electrical outlet 82, upward pressure on the electrical outlet 82 causes the flanges 66 to depress the flanges 96, permitting the flanges 96 to slide past the flanges 66. Once the flanges 96 are above the flanges 66, the spring retention members are spring-biased outward towards their original position, wherein the flanges 96 engage the flanges 66. To remove the electrical outlet 82, the finger portions 98 are depressed, thereby depressing the spring retention members 94 inward so that the flanges 96 no longer engage the flanges 66, permitting the electrical outlet 82 to be removed.

A bus system 10 of the present invention provides ease of assembly and compactness exceeding other bus systems. Unlike some other bus systems, it is unnecessary to remove any material from the bus insulator 16 to install a joint insulator 26 between adjacent bus sections 12, to provide insulation around the ends 50 of the buses 18, 20, 22, 24. It is also unnecessary to perform any operation to provide electrical connection between adjacent bus sections other than merely snapping the connector 28 into place. This ability to assemble bus sections 12 into bus systems 10 without performing any operations other than fitting the appropriate parts together provides unprecedented ease of assembly.

The bus system 10 of the present invention also provides sufficient resistance to prevent electrical shorts within a smaller space than other bus systems. By locating the buses 18, 20, 22, 24 within the center portions 38 of the U-shaped sections 30, 32, 34, 36, and joining the adjacent U-shaped sections 30, 32, 34, 36 at their end portions 40, the passage of electricity from one bus to another would require the current to pass down the length of a first wall 44 across an insulator connector portion 46 or 48, and up through the length of a second wall 44. The total distance such current must travel is thereby maximized in a manner that keeps the buses 18, 20, 22, 24 relatively close together. Because total resistance is a function of both the resistivity of the material, and the distance through which current must travel within the material, this large distance through the bus insulator 16 between one bus and its adjacent bus provides a sufficiently high level of total resistance. Because the resistivity of air is greater than the resistivity of most electrical insulators, the buses 18, 20, 22, 24 may be located relatively close to each other without danger of current passing directly from the center portion 38 of one U-shaped section 30, 32, 34, 36, directly through the air between U-shaped sections, to the center portion 38 of an adjacent U-shaped section. Additionally, because the electrical potential between the buses 18 and 22 and the neutral bus 20 is approximately half the potential between a pair of live buses, for example, the buses 22 and 24, locating the neutral bus 20 between the live buses 18 and 22 permits the buses 18, 20, 22 to be positioned relatively close together, minimizing the length of material required for the insulator connector portion 46. The only place wherein a large amount of space between adjacent buses is required, is between the two adjacent live buses 22, 24, resulting in a longer insulator connector portion 48.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An electrical bus section, said bus section having a pair of ends, said bus section comprising:

at least two buses, each bus having a pair of end portions;

a bus insulator having a U-shaped portion defining a channel corresponding to each of said at least two buses, said U-shaped portions having a pair of end portions and a center portion, each of said buses being located in the center portion, and each of said U-shaped portions being connected to an adjacent U-shaped portion at one of said end portions, said bus insulator leaving said end portions of said buses exposed;

a housing surrounding said bus insulator, said housing including means for removably securing an electrical load to said bus section, and means for securing said bus section to a desired location; and a joint insulator within said ends of said housing, said joint insulator being dimensioned and configured to insulate said ends of said buses and to permit insertion of a connector over said ends of said buses.

2. The bus section according to claim 1, wherein said at least two buses are four in number.

3. The bus section according to claim 2, wherein said buses form a three phase system.

4. The bus section according to claim 1, wherein said housing further comprises a bus mounting section, a middle section, and an electrical load mounting section, said bus mounting section including said means for securing said bus section to a desired location, and said electrical load mounting section including said means for removably securing an electrical load to said bus section.

5. The bus section according to claim 4, wherein said means for removably securing an electrical load to said bus section is at least one inwardly projecting flange within said electrical load mounting section.

6. The bus section according to claim 4, wherein said said means for securing said bus section to a desired location is at least one horizontal flange.

7. The bus section according to claim 1, wherein said U-shaped portions of said bus insulator are oriented so that the end portions are oriented towards said electrical load mounting portion of said housing.

8. The bus section according to claim 1, wherein said joint insulators are retained between said bus insulator and said housing.

9. A connector for an electrical bus section, comprising:

an electrically insulating body, and an electrically conductive U-shaped section corresponding to each pair of corresponding buses within adjacent bus sections, said electrically conductive U-shaped section being dimensioned and configured to snap onto end portions of the corresponding bus sections.

10. The bus system according to claim 9, wherein said at least two buses are four in number.

11. The bus system according to claim 10, wherein said buses form a three phase system.

12. The bus system according to claim 9, wherein said housing further comprises a bus mounting section, a middle section, and a electrical load mounting section, said bus mounting section including said means for securing said bus section to a desired location, and said electrical load mounting section including said means for removably securing an electrical load to said bus section.

13. The bus system according to claim 12, wherein said means for removably securing an electrical load to said bus section is at least one inwardly projecting flange within said electrical load mounting section.

14. The bus system according to claim 12, wherein said said means for securing said bus section to a desired location is at least one horizontal flange.

15. The bus system according to claim 9, wherein said U-shaped portions of said bus insulator are oriented so that the end portions are oriented towards said electrical load mounting portion of said housing.

16. The bus system according to claim 9, wherein said electrically insulating body of said connector further comprises at least one channel, each of said at least one channel being dimensioned and configured to receive a wall of a joint insulator.

17. A bus section, comprising:

a pair of live buses; and a neutral bus located between said live buses.

18. A bus section, comprising:

a pair of live buses;

a bus insulator having a U-shaped portion defining a channel corresponding to each of said buses, said U-shaped portions having a pair of end portions and a center portion, each of said buses being located in the center portion, and each of said U-shaped portions being connected to an adjacent U-shaped portion at one of said end portions, said bus insulator leaving said end portions of said buses exposed;

a housing surrounding said bus insulator, said housing including means for removably securing an electrical load to said bus section, and means for securing said bus section to a desired location; and a joint insulator within said ends of said housing, said joint insulator being dimensioned and configured to insulate said ends of said buses and to permit insertion of a connector over said ends of said buses.

19. The bus section according to claim 18, wherein said housing further comprises a bus mounting section, a middle section, and a electrical load mounting section, said bus mounting section including said means for securing said bus section to a desired location, and said electrical load mounting section including said means for removably securing an electrical load to said bus section.

20. The bus section according to claim 19, wherein said means for removably securing an electrical load to said bus section is at least one inwardly projecting flange within said electrical load mounting section.

21. The bus section according to claim 19, wherein said means for securing said bus section to a desired location is at least one horizontal flange.

22. The bus section according to claim 19, wherein said U-shaped portions of said bus insulator are oriented so that the end portions are oriented towards said electrical load mounting portion of said housing.

23. The bus section according to claim 18, wherein said joint insulators are retained between said bus insulator and said housing.

24. The bus section according to claim 18, further comprising a neutral bus located between said live buses.

* * * * *